US007922114B2

(12) United States Patent
Marcelli et al.

(10) Patent No.: US 7,922,114 B2
(45) Date of Patent: Apr. 12, 2011

(54) EXPANDING-MANDREL WINDER FOR REEL

(76) Inventors: Pierre Marcelli, Laveze (FR); Julien Marcelli, Laveze (FR)

( * ) Notice: Subject to any disclaimer, the term of this patent is extended or adjusted under 35 U.S.C. 154(b) by 40 days.

(21) Appl. No.: 12/307,053

(22) PCT Filed: Jul. 4, 2007

(86) PCT No.: PCT/FR2007/001131

§ 371 (c)(1),
(2), (4) Date: Dec. 30, 2008

(87) PCT Pub. No.: WO2008/003860

PCT Pub. Date: Jan. 10, 2008

(65) Prior Publication Data

US 2009/0294572 A1 Dec. 3, 2009

(30) Foreign Application Priority Data

Jul. 5, 2006 (FR) ..... 06 06099

(51) Int. Cl.
*B65H 75/24* (2006.01)
*B65H 49/30* (2006.01)

(52) U.S. Cl. ..... 242/571.3; 242/576

(58) Field of Classification Search ..... 242/571, 242/571.3, 571.4, 571.5, 572, 574, 574.1, 242/574.2, 574.3, 574.4, 575, 575.1, 575.4, 242/575.5, 576

See application file for complete search history.

(56) References Cited

U.S. PATENT DOCUMENTS

| | | | | |
|---|---|---|---|---|
| 1,031,155 | A | 7/1912 | Williams | |
| 4,793,801 | A * | 12/1988 | Roman et al. | 432/5 |
| 7,523,886 | B2 * | 4/2009 | Kim | 242/571.3 |

FOREIGN PATENT DOCUMENTS

| | | |
|---|---|---|
| DE | 823583 | 7/1949 |
| DE | 3706557 A1 | 9/1988 |
| EP | 0427281 A2 | 5/1991 |
| FR | 2583027 A1 | 12/1986 |
| GB | 1102770 | 2/1968 |

OTHER PUBLICATIONS

Machine translation of FR 2583027.*

* cited by examiner

*Primary Examiner* — Michael R Mansen
*Assistant Examiner* — William E Dondero
(74) *Attorney, Agent, or Firm* — Davis & Bujold, P.L.L.C.

(57) ABSTRACT

A winder in which the jaws of the mandrel expand automatically by the weight of the reel, without introducing external energy. The winder has a mandrel of horizontal axis (A) whose jaws are expandable by means of links hinged to the end of a sliding pull rod and connected to the frame by a hinged connecting rod. The winder includes a rocker connected to the frame by a fixed pivot axis (D) and to the mandrel by the physical embodiment of the axis of rotation (A), the two axes (D, A) are parallel. The rocker moves the mandrel vertically between a raised loading position and a lowered use position under the weight of a reel and it brings about, simultaneously, sliding of the pull rod, automatic expansion of the jaws, and automatic clamping of the reel.

16 Claims, 5 Drawing Sheets

14
20
21
22
30
32
33
41
42
44
45
50
52
53
60
62
66
67
A
B
C
D

EXPANDING-MANDREL WINDER FOR REEL

This application is a national stage completion of PCT/FR2007/001131 filed Jul. 4, 2007, which claims priority from French Patent Application Serial No. 06/06099 filed Jul. 5, 2006.

TECHNICAL DOMAIN

The present invention concerns an expanding-mandrel winder for a reel equipped with at least one mandrel attached to a frame, said mandrel comprising jaws that move between a loading position in which the jaws are contracted and a use position in which the jaws are expanded and maintain the reel on a generally horizontal axis.

PRIOR ART TECHNIQUE

The use of continuous strips of material packaged on reels is widespread in several industrial sectors such as the manufacture of paper, cardboard, metals, textiles, etc. These reels are generally supported on winders with a horizontal axle placed at the head of the production line. The winders comprise expanding mandrels equipped with jaws. The expansion systems for the mandrels may use links or ramps. Displacing the ramps or links to make the jaws expand and clamp the reel is accomplished either by using a nut and bolt system connected to a crank requiring manual action or by using a hydraulic cylinder to directly activate the central pull rod connected to the jaws.

Expanding and contracting the jaws of the mandrel with a crank are operations that must be performed each time a reel is changed. Besides being a laborious maneuver, this entails slowing the speed considerably due to the weight of the reels, and requires a significant number of rotations to occur before the crank is thrown sufficiently. This long and repetitive operation is exacting and does not necessarily guarantee that the jaws will tightly clamp the interior diameter of the reel. The quality of the clamping essentially depends upon the operator's performance.

With the hydraulic cylinder system, the jaws of the mandrel are quickly expanded and contracted because the operations take place through a simple action on a button or control lever, but this system requires the installation of specific hydraulic equipment such as a hydraulic group, a pipe network, a distribution system, a cylinder, seals, etc. Installing this equipment is very costly and frequent intervention is necessary for maintenance and seal replacement. In addition to the pollution this cylinder system may create, it is noisy and generates heat. Furthermore, it consumes a great deal of electricity.

None of these solutions is satisfactory.

In addition, depending upon their diameter, the reels are stored and transported either in an upright position, with their axes horizontal, or lying flat, with their axes vertical. In the upright position they can be grasped by the forks of a forklift for loading directly on the mandrels with their axes horizontal. When lying flat they are grasped by the forks of a forklift and must be tipped a quarter turn before loading onto the mandrels. This turning operation is dangerous and is usually done either by suspension from the hook of a traveling crane or directly by the forklift. To perform this turning operation with utmost safety, there are specialized machines called tipping devices. However, using them requires supplemental reel handling operations. Moreover, they represent a considerable investment, they are cumbersome, and they require an additional energy source.

Publication FR 2 583 027 proposes a winder with a vertical axle mandrel that expands under the weight of the reel and causes a platform to descend in order to open the jaws. In order to use the reel, the mandrel must be tilted a quarter turn and the reel must be blocked in position. This system is not satisfactory, since it requires an actuator for tilting the mandrel and mechanically blocking the reel in position, as the jaws do not lock around the interior diameter of the reel until the axle of the mandrel is horizontal.

DESCRIPTION OF THE INVENTION

The present invention proposes a novel solution that simultaneously eliminates the drawbacks of the crank system and the cylinder system for expanding and contracting the jaws of the mandrel and which is also economical, simple, free of upkeep or additional energy requirements, and ensures optimal, reproducible clamping of the reel in position for use by the jaws. The invention further proposes an integrated solution for tilting the reels when they are loaded in flat position, while still ensuring that they are clamped in position for use.

To achieve this, the invention concerns a mandrel of the type indicated in the preamble, characterized in that it comprises a means for generating automatic expansion of the jaws under the weight of the reel and causes the jaws to clamp the interior diameter of the reel, with the clamping force of the jaws being proportionate to the weight of the reel, placing the mandrel in position for use.

The winder advantageously comprises a recall device coupled with said means and designed to make the jaws contract automatically in the absence of a reel and return the mandrel to the loading position, as well as a blocking mechanism to lock the mandrel in position for use.

In a preferred manner, the divider comprises an expansion device connected to the jaws of the mandrel and said means comprises a device for guiding the mandrel between at least a loading position and a position for use, with the guide device being connected to the expansion device so as to cause the jaws to expand automatically as the mandrel is simultaneously displaced under the weight of the reel.

In a preferred embodiment, the expansion device comprises a pull rod connected to the jaws by a variable shape device, said pull rod sliding inside the axle of the mandrel to displace the jaws between the loading and unloading positions. The pull rod is preferably connected to the frame with a mechanical connector selected from the group comprising a hinged link, a rack and pinion system, a cylinder, a slide, or a combination of these devices.

In a first variation of the device, the mandrel's loading and unloading positions are parallel and the guide device displaces the mandrel along a generally rectilinear trajectory.

In this case, the guide device may comprise a rocker connected to the frame by a fixed pivot axle and to the mandrel by its rotational axle, the two axles being parallel. It may also comprise a trolley connected to the mandrel by its rotational axle and sliding within the frame along an axle perpendicular to the rotational axle of the mandrel.

In a second variation, the mandrel's loading and unloading positions are perpendicular and the guide device displaces the mandrel along a generally circular trajectory.

In this case the guide device comprises a rocker arm connected to the frame by a fixed pivot axle and to the mandrel by its rotational axle, both axles being perpendicular and offset. Also in this case, the mandrel comprises a receiving platform for receiving the reel in loading position and the recall device comprises a counterweight connected to the rocker.

In this embodiment, the winder advantageously comprises a controlled lifting device located between the frame and the rocker arm, designed to lock the mandrel in the loading and use positions and to control its return to the loading position.

In the preferred embodiment, the guide device comprises a guide socket, the axle of which merges with the rotational axle of the mandrel within which the pull rod slides using a casing connected to the jaws of the mandrel by a variable shape mechanism, said casing and pull rod being co-axial and rotationally movable on the mandrel's rotational axle A.

The winder may also comprise stops defining the mandrel's loading and unloading positions.

SUMMARY DESCRIPTION OF THE DRAWINGS

The present invention and its advantages will be more readily apparent from the following description of several embodiments given by way of non-limiting examples, with reference to the attached drawings, in which:

FIGS. 1A and 1B are schematics of the principle of a first embodiment of a winder having a horizontal axle mandrel according to the invention, in the contracted and expanded positions, respectively;

FIGS. 2A and 2B, 3A and 3B, and 4A and 4B are schematics similar to FIGS. 1A and 1B of a second, third, and fourth embodiment of a winder according to the invention;

ILLUSTRATIONS OF THE INVENTION

Figure 1A:
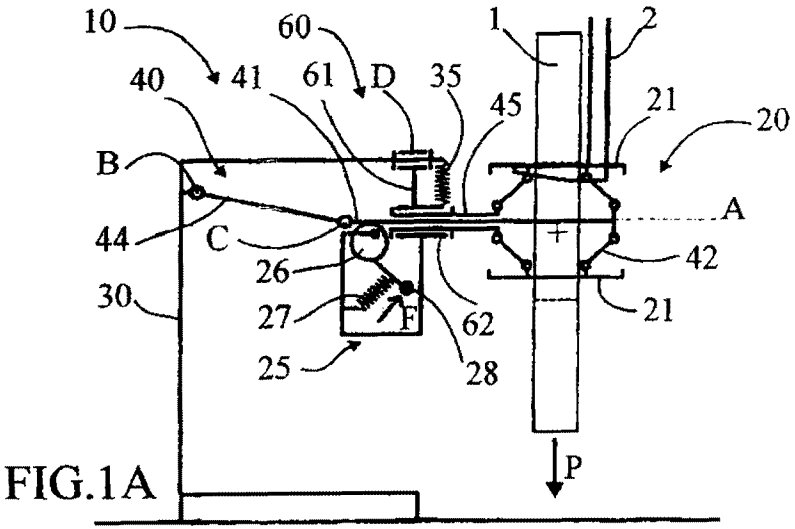

The expanding-mandrel winder 10-15 according to the invention is designed to receive any type of reel 1 of material packaged in a strip—cable, wire, or the like—for supplying any type of manufacturing machine, particularly rolls of sheet metal. It comprises one or more mandrels 20 supported by a frame 30 or any other equivalent structure, each mandrel 20 comprising at least three equidistant jaws 21 for maintaining reel 1 by clamping its interior diameter. Said jaws 21 are attached so as to rotate freely on a rotational axle A so that reel 1 rotates and allows the material pulled by the manufacturing machine to unwind.

According to the invention, the weight of reel 1 is used to provoke expansion of jaws 21 and clamping of reel 1 without any handling, activation, or supplemental exterior energy. The invention also concerns a winder 10-13 with a horizontal axle expanding mandrel as in FIGS. 1 through 5, for which the loading position and use position of reel 1 are parallel to the rotational axle A of mandrel 20, as well as a winder 14-15 with a tilting expanding mandrel as in FIGS. 6 through 8, for which the loading position and use position for reel 1 are perpendicular.

Various embodiments of winder 10-13 with a horizontal axle expanding mandrel are illustrated with reference to FIGS. 1-4, said variations not being exhaustive in nature, but on the contrary, furnishing an idea of the multiple solutions possible.

As in FIGS. 1-4, winder 10-13 comprises an expanding mandrel 20 with jaws 21 that are movable between a loading position (Figure A) in which they are contracted to permit loading and unloading of reel 1 with a handling apparatus 2, and a use position (Figure B) in which they are expanded and maintain reel 1 by clamping it. The loading position corresponds to mandrel 20 being in the stable or resting position, and the use position corresponds to mandrel 20 being in the unstable or working position. Jaws 21 are connected to an expansion device 40 comprising a pull rod 41 sliding in the rotational axle A of mandrel 20. Pull rod 41 is connected to jaws 21 by a variable shape mechanism comprising links 42 (FIGS. 1 through 3) or ramps 43 (FIG. 4) designed to separate or reclamp jaws 21 depending upon whether pull rod 41 is pulled or pushed.

According to the invention, winder 10-13 comprises a means for provoking the automatic expansion of jaws 21 under the weight of reel 1. This means comprises a guide device 60 for mandrel 20 for displacing it vertically between an upper loading position (Figure A) and a lower use position (Figure B), said positions being parallel and horizontal to the rotational axle A. This guide device 60 is connected to pull rod 41 by a connector that slides along rotational axle A. Winder 10-13 comprises a recall device 35 to cause mandrel 20 to return from its lower use position to its upper loading position, and simultaneously to contract jaws 21 automatically in the absence of reel 1. This recall device 35 may consist of a spring, a counterweight balance system, a pneumatic spring, a gas charged spring, a torsion bar type spring, or other equivalent system preferably disposed between guide device 60 and frame 30. Winder 10-13 may be completed by a blocking mechanism 25 designed to lock mandrel 20 in position for use.

Figure 1B:
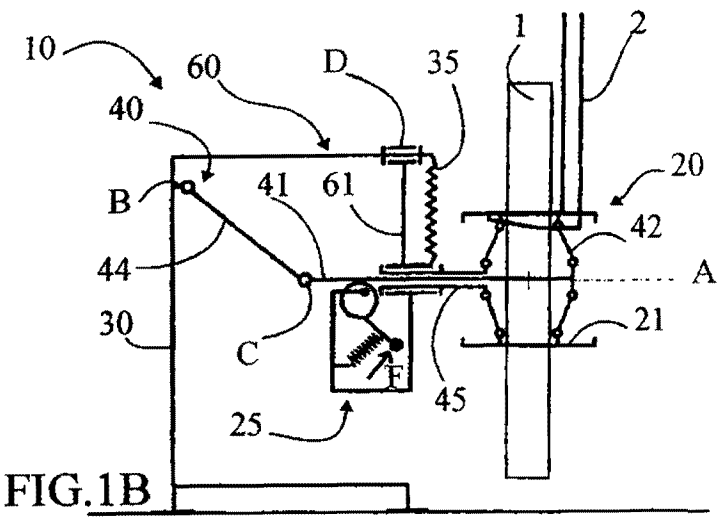

In FIGS. 1A and 1B, pull rod 41 of winder 10 is connected to frame 30 by a connecting rod 44 articulated between a fixed articulating axle B connected to frame 30 and a movable articulating axle C provided at the rear extremity of pull rod 41, said two axles B and C preferably being offset at the top when mandrel 20 is in the stable position to start the movement of pull rod 41 and prevent any harmful concentration of force. In FIG. 1A, fixed articulating axle B is situated above movable articulating axle C so that when pull rod 41 is displaced parallel to itself, its movable articulating axle C describes a downward arc around fixed articulating axle B.

Guide device 60 comprises a rocker 61 attached to pivot between a fixed pivot axle D connected to frame 30 and the rotational axle A of mandrel 20, said two axles D and A being parallel. Rocker 61 comprises a guide socket 62 with axle A in which a turning casing 45 is mounted, traversed by sliding pull rod 41. Said casing 45 is connected to jaws 21 by hinged links 42 and forms the fixed contact point for expansion device 40. Since rocker 61 pivots, it drives mandrel 20 between its upper loading position and lower use position on a circular trajectory around fixed pivot axle D. In this configuration, fixed articulating axle B and movable axle C of rod 44 consist of ball and socket connectors. Recall device 35 is, in this example, a traction spring connected between socket 62 and frame 30. Blocking mechanism 35 is located on rocker 61 and comprises a cam 26 in frictional contact with pull rod 41 urged by traction spring 27 and joined to a release handle 28. Manual action on handle 28 in the direction of arrow F causes cam 26 to turn and decreases its radius, freeing pull rod 41. In the opposite direction, the radius of cam 26 increases and prevents any displacement of pull rod 41. Handle 28 may be replaced by any other control means, manual or automatic, such as a cylinder.

The functioning of this winder 10 is described below. With reference to FIG. 1A, mandrel 20 is in the upper loading position ready to receive reel 1. When a full reel 1 is deposited on mandrel 20 by a handling device 2, the weight P of reel 1 is transmitted to rocker 61 through jaws 21 and rotational axle A and creates a rotating connection. Rocker 61 pivots about its fixed pivot axle D and displaces mandrel 20 parallel to itself from its upper to its lower position while driving pull rod 41. Simultaneously, movable articulating axle C on pull rod 41 pivots downward around fixed articulating axle B, displacing and driving pull rod 41, causing the expansion of jaws 21. The right to left displacement of pull rod 41 in FIG. 1 reduces the radius of cam 26, allowing it to be displaced. When the jaws 21 make contact with the interior diameter of reel 1, pull rod 41 is blocked and mandrel 20 becomes stabilized in its lowered use position, with reference to FIG. 1B, handling apparatus 2 can be removed, and reel 1 may be used normally. This use position is automatically locked by cam 26 on blocking mechanism 25 which prevents left to right movement by pull rod 41, and thus prevents any unwanted upward movement by mandrel 20 when reel 1 becomes empty. Said reel 1 supported by jaws 21 of mandrel 20 can turn freely due to the fact that casing 45 and pull rod 41 are coaxial and attached so as to turn on rotational axle A. Any other equivalent arrangement may also be used.

The greater the weight P of reel 1, the tighter the grip of jaws 21 on its interior diameter. Thus, clamping is proportionate to the weight P of reel 1, ensuring that reel 1 is maintained correctly. It is possible for winder 10 to have mechanical stops provided on frame 30 in order to define the loading and use positions of mandrel 20.

When reel 1 is empty and handle 28 on blocking mechanism 25 is activated to unlock mandrel 20 from the use position, recall device 35 automatically raises mandrel 20 again from the use position to the loading position. As it moves, mandrel 20 causes rocker 61 to pivot backwards on its fixed pivot axle D. Simultaneously, movable articulating axle C on pull rod 41 pivots upward around its fixed articulating axle B, pushing and displacing pull rod 41, which causes jaws 21 to contract. When jaws 21 are contracted, mandrel 20 becomes stabilized in the upper loading position with reference to FIG. 1A, handle 28 can be released, and handling apparatus 2 can load a new reel.

Figure 2A:
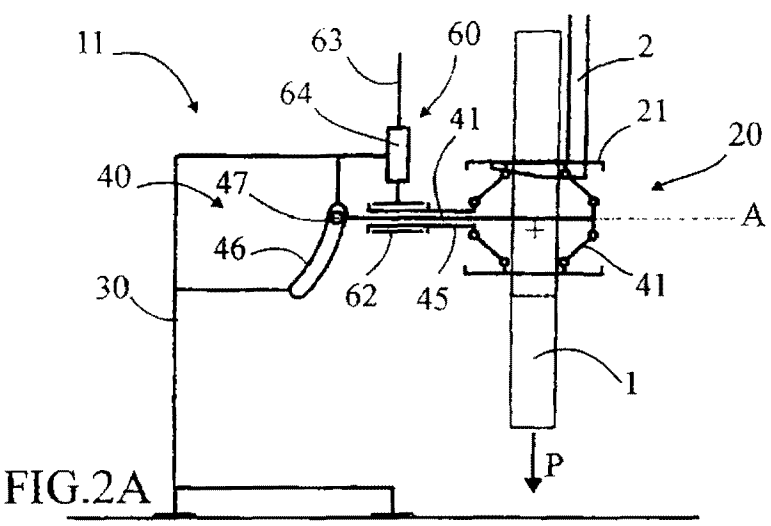
Figure 2B:
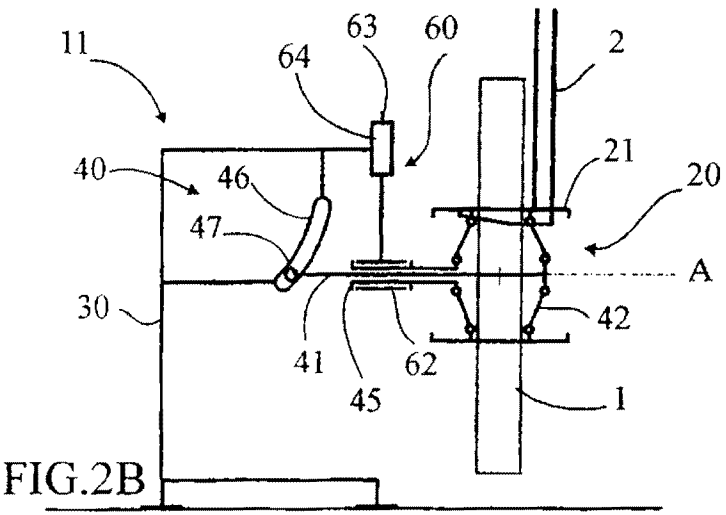
Figure 3A:
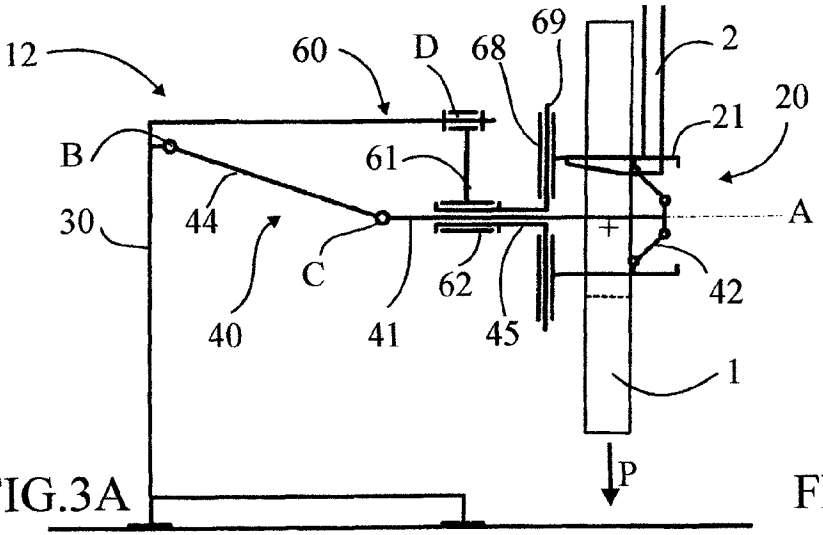
Figure 3B:
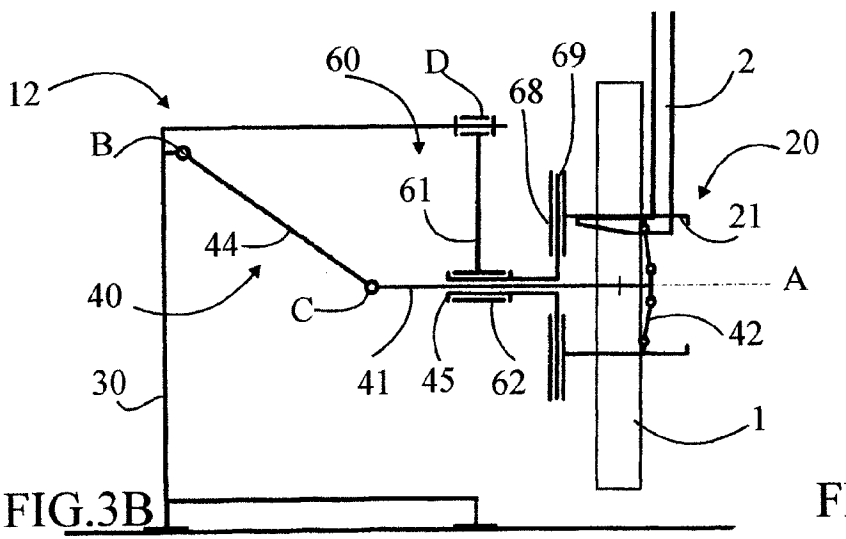

The embodiment of winder 11 illustrated in FIGS. 2A and 2B is differentiated from the preceding one by the fact that pull rod 41 is connected to frame 30 by a sliding connector. For this purpose, frame 30 is equipped with a rail 46 forming a cam profile within which there circulates a roller 47 provided on the rear extremity of pull rod 41. In this case, guide device 60 comprises a trolley 63 equipped with lateral rollers circulating within fixed vertical rails 64 at the front of frame 30 or any other equivalent system. Winder 11 may include a recall device 35 and a blocking mechanism 25 (not shown) as in the preceding example. Winder 12 in the variation illustrated in FIGS. 3A and 3B is similar to winder 10. The difference resides only in the connection between casing 45 and jaws 21, which is a sliding vertical connection using a trolley system 69 moving within rails 68 or any other equivalent means. This connection ensures that jaws 21 are guided during the expansion and contraction caused by links 42.

Figure 4A:
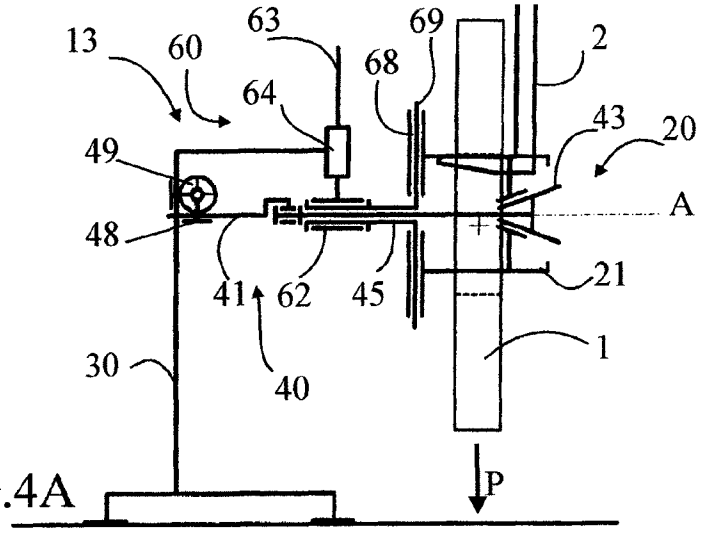
Figure 4B:
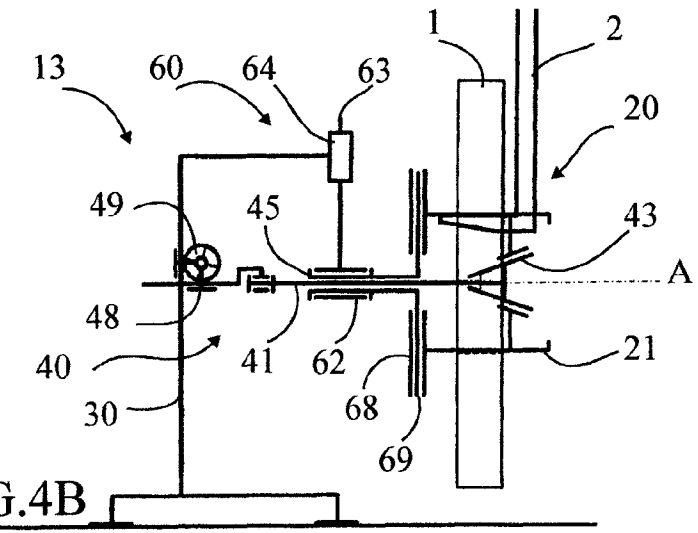

In winder 13 of FIGS. 4A and 4B, pull rod 41 is connected to frame 30 by a rack and pinion system. Pull rod 41 has a rack 48 at its rear extremity that engages a pinion 49 attached to frame 30 by a connection sliding along a vertical axle. In a variation that is not shown, the pinion may be located on the pull rod and the rack on the frame. Pull rod 41 comprises a first portion joined to jaws 21 by ramps 43 and a second portion supporting rack 48, the first portion rotating on rotational axle A relative to the second portion. In this embodiment guide device 60 comprises a sliding trolley 63 and casing 45 is connected to jaws 21 by a sliding trolley 69, said sliding connections being perpendicular to the rotational axle A of mandrel 20.

Since the functioning of winders 11 through 13 illustrated in FIGS. 2 through 4 is similar to the operation of winder 10 in FIG. 1, it will not be explained again.

Figure 5B:
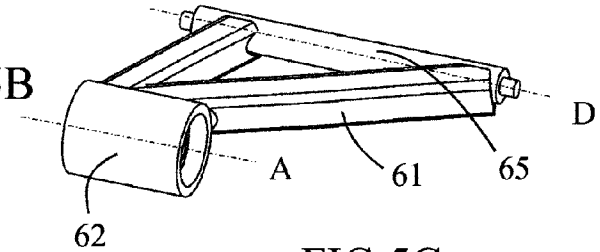
FIGS. 5B through 5E are detailed views of the parts of the winder in FIG. 5A.
Figure 5C:
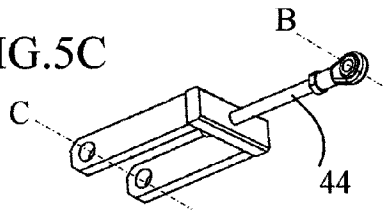
Figure 5D:
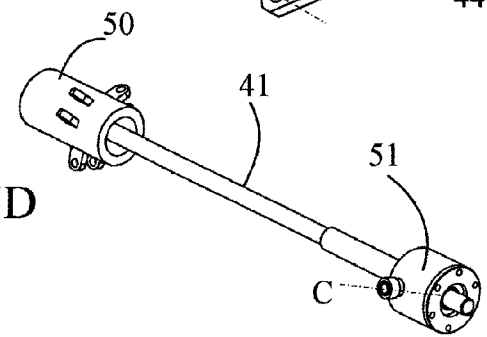
Figure 5E:
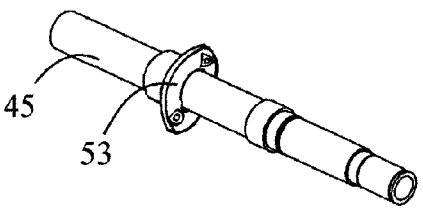
Figure 5A:
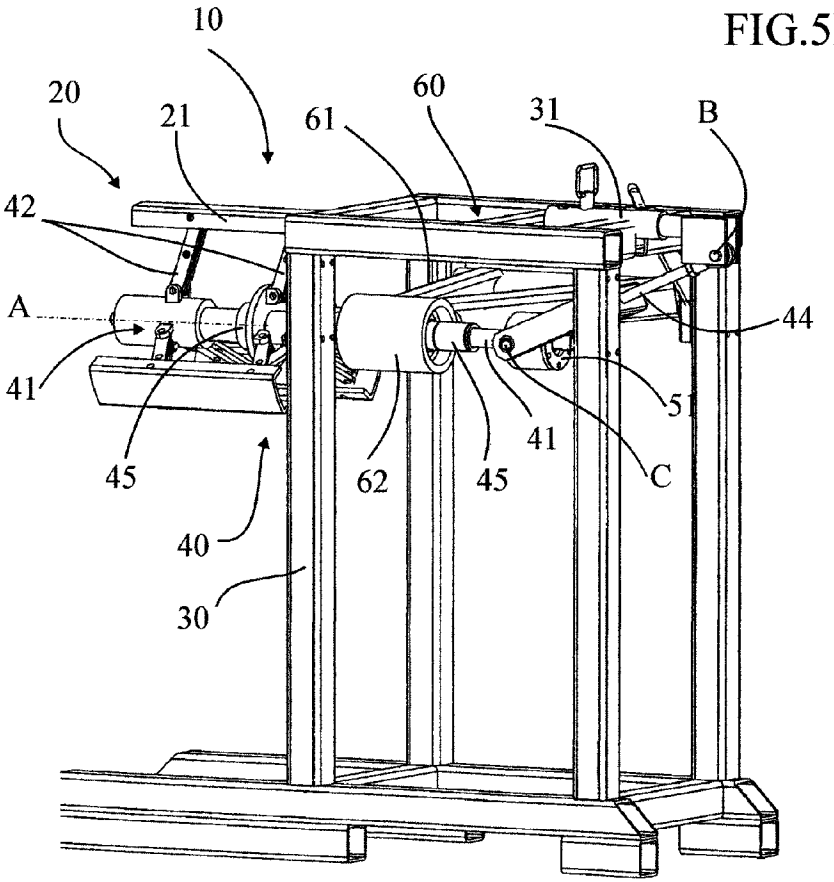
FIG. 5A is a perspective view of a winder according to the first embodiment in FIGS. 1A and 1B.

An expanding-mandrel winder 10 with a horizontal axle according to the first embodiment of FIGS. 1A and 1B is illustrated in FIG. 5A. This winder 10 comprises an expanding mandrel 20 supported by a frame 30 resting on the floor. Said frame 30 may also constitute a module or it may form part of a gantry crane or a winder supporting a plurality of expanding mandrels 20. This expanding mandrel 20 comprises three equidistant jaws 21 on its rotational axle A.

Jaws 21 are connected to a pull rod 41 forming rotational axle A and represented in detail in FIG. 5D. Pull rod 41 is cylindrical and comprises a first socket 50 located at its front extremity connected to jaws 21 with links 42. It comprises a second socket 51 located at its rear extremity connected to a rod 44 by two ball joint connections forming movable articulating axle C. This rod 44 is shown in detail in FIG. 5C and comprises a shaft connected to frame 30 by a ball joint connection forming fixed articulating axle B and a U-shaped bracket connected to pull rod 41 with the two ball joint connections on movable articulating axle C, axle B being parallel and located above axle C. Pull rod 41 is attached to its axle A so it rotates relative to movable articulating axle C using a bearing case and axial stops (not shown) or other equivalent means provided in second socket 51.

This winder 10 comprises a rocker 61 shown in detail in FIG. 5B with a shaft 65 connected to frame 30 by a fixed pivot axle D provided on one side of frame 30 and a guide socket 62 connected to mandrel 20 by rotational axle A, fixed pivot axle D being parallel and situated above axle A. A cylindrical casing 45, shown in detail in FIG. 5E, is attached in guide socket 62 by a bearing case and axial stops (not shown) or other equivalent means so that it turns. It comprises a socket 53 connected to jaws 21 by links 42 forming a fixed contact point for expansion device 40. This casing 45 is traversed by pull rod 41 attached so as to move in translation and in rotation by means of bearings and axial stops (not shown) or any equivalent means.

In this embodiment, fixed articulating axle B between rod 44 and frame 30 is adjustable in position and attached to the extremity of a telescopic support 31, such as a cylinder that can be adjusted manually or automatically. Modifying the position of fixed articulating axle B modifies the diameter of jaws 21 and adapts mandrel 20 to different size diameters of reels 1.

This winder 10 also includes a recall device 35 (not shown) which may be a traction spring attached between rocker 61 and frame 30 as in the example shown in FIGS. 1A and 1B. It may also comprise a mechanical stop located on frame 30 to limit the course of mandrel 20 and/or a blocking mechanism 25 (not shown) as shown in FIGS. 1A and 1B.

In the embodiments shown schematically in FIGS. 6 and 7, winders 14 and 15 comprise an expanding mandrel 20 that tips to alternate between a vertical loading position (Figure A) and a horizontal use position (Figure B). All parts that are similar to the preceding embodiments bear the same reference numerals and no further details are supplied. The essential difference with horizontal axle, expanding-mandrel winder 10-13 resides in the rocking connection of mandrel 20 on fixed pivot axle D perpendicular to rotational axle A of mandrel 20 and offset toward the rear relative to said axle A so that it tips from a loading position to a use position automatically under the weight of reel 1. Winder 14-15 comprises a recall device consisting of a counterweight 36 designed to cause mandrel 20 to return from the use position to the loading position and simultaneously cause jaws 21 to contract in the absence of reel 1. This recall device may consist of any other equivalent system such as a spring, a pneumatic spring, a gas spring, or a torsion bar spring. Winder 14-15 includes a lifting device 37 consisting of a pneumatic cylinder or the like to raise mandrel 20 to the loading position if reel 1 is not empty, for example. This lifting device 37 also serves to lock the loading and use positions.

Figure 6A:
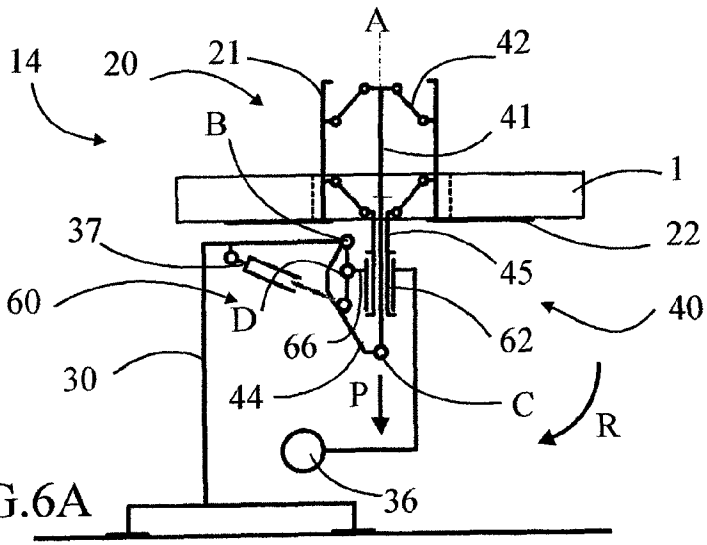
FIGS. 6A and 6B are schematics of the principles of a first embodiment of a winder with a tilting mandrel according to the invention in the contracted and expanded positions, respectfully.
Figure 6B:
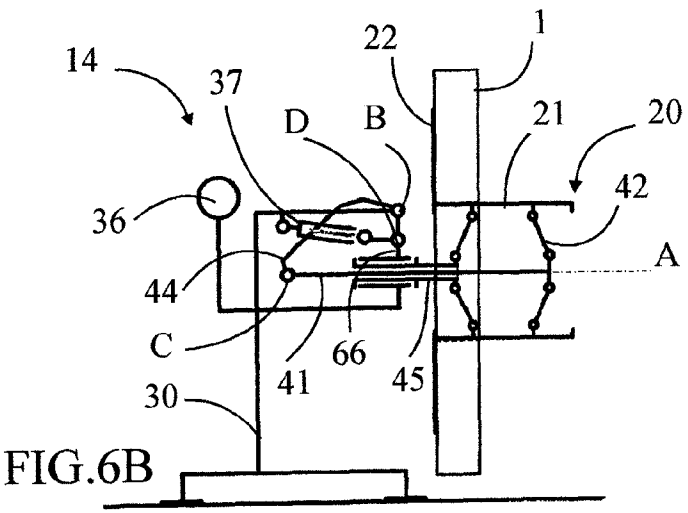

In the example of FIGS. 6A and 6B, winder 14 comprises, at the base of jaws 21, a receiving platform 22 for reel 1 perpendicular to rotational axle A. This receiving platform 22 is equipped with passages for the forks of a handling device (not shown). Guide device 60 comprises a rocker arm 66 connected to frame 30 by a fixed pivot axle D and to mandrel 20 by rotational axle A, said two axles D and A being perpendicular. Mandrel 20 is displaced between its loading position and its use position along a circular trajectory around fixed pivot axle D. In this configuration, fixed axle B articulating connecting rod 44 to frame 20 is located above and near fixed pivot axle D of rocker arm 66 on frame 30 so as to displace movable articulating axle C on pull rod 41 along a combined rotational/translational trajectory while rocker arm 66 rotates. Counterweight 36 on the recall device is connected to rocker arm 66 and ensures that it remains balanced. The cylinder of lifting device 37 is attached between frame 30 and rocker arm 66 at a separate articulation point on fixed pivot axle D.

The functioning of this embodiment is described below. With reference to FIG. 6A, mandrel 20 is in the loading position ready to receive flat reel 1, with a vertical axle. When a full reel 1 is deposited on receiving platform 22 of mandrel 20 by a handling device, the weight P of reel 1 is transmitted to rocker arm 66 through receiving platform 22 and rotational axle A. Since rotational axle A of mandrel 20 is offset toward the front relative to pivot axle D, this creates a rotational torque R causing rocker arm 66 to rotate automatically on its fixed pivot axle D. Rocker arm 66 drives mandrel 20 in rotation along with it, passing from the loading position to the use position in which the axle of mandrel 20 is horizontal. Simultaneously, movable articulating axle C of pull rod 41 pivots on its fixed articulating axle B to describe a combined rotational/translational trajectory, displacing pull rod 41 and causing jaws 21 to expand. When mandrel 20 becomes stabilized in its use position referenced in FIG. 1B, jaws 21 have attained the position in which they clamp the interior of reel 1 and reel 1 may be used normally. Said reel 1 turns freely thanks to casing 45 and pull rod 41, which are coaxial and attached rotationally. Any other equivalent construction may be used.

Figure 7A:
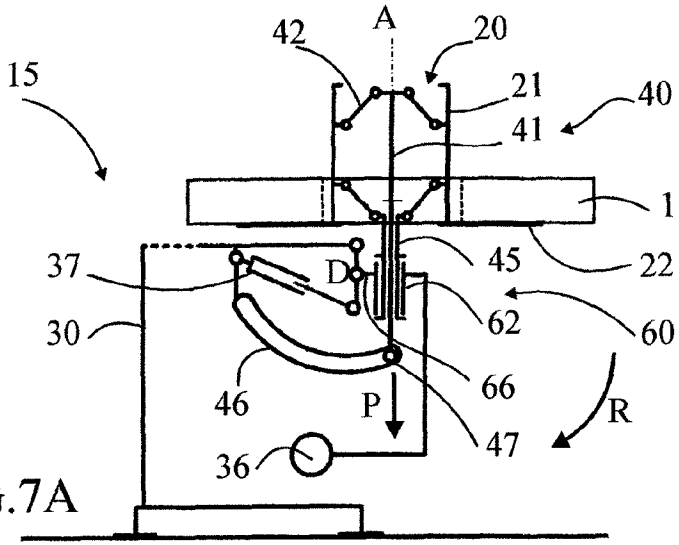
FIGS. 7A and 7B are schematics similar to FIGS. 6A and 6B of a second embodiment of a winder according to the invention.
Figure 7B:
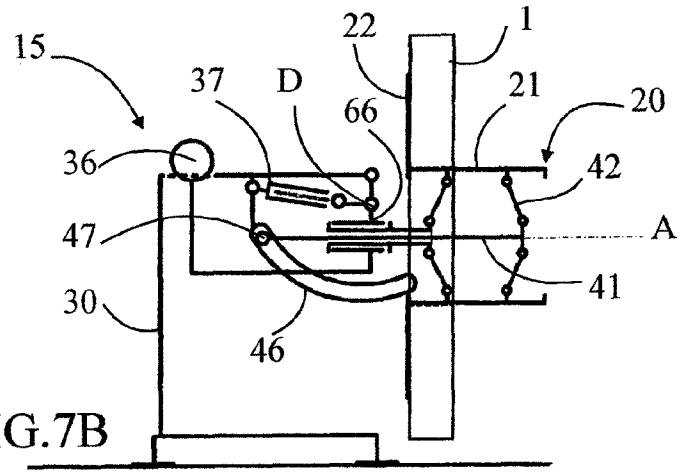

In winder 15 in FIGS. 7A and 7B, pull rod 41 is connected to frame 30 by a sliding connection obtained using a cam profile rail 46 in which there circulates a roller 47 located at the rear extremity of pull rod 41. The cam profile of rail 46 is determined relative to the trajectory that the rear extremity of pull rod 41 must follow while mandrel 20 is rotating between its loading and use positions, and vice versa, to make jaws 21 expand and contract.

Figures 8A, 8B, 8C, 8D, 8E:
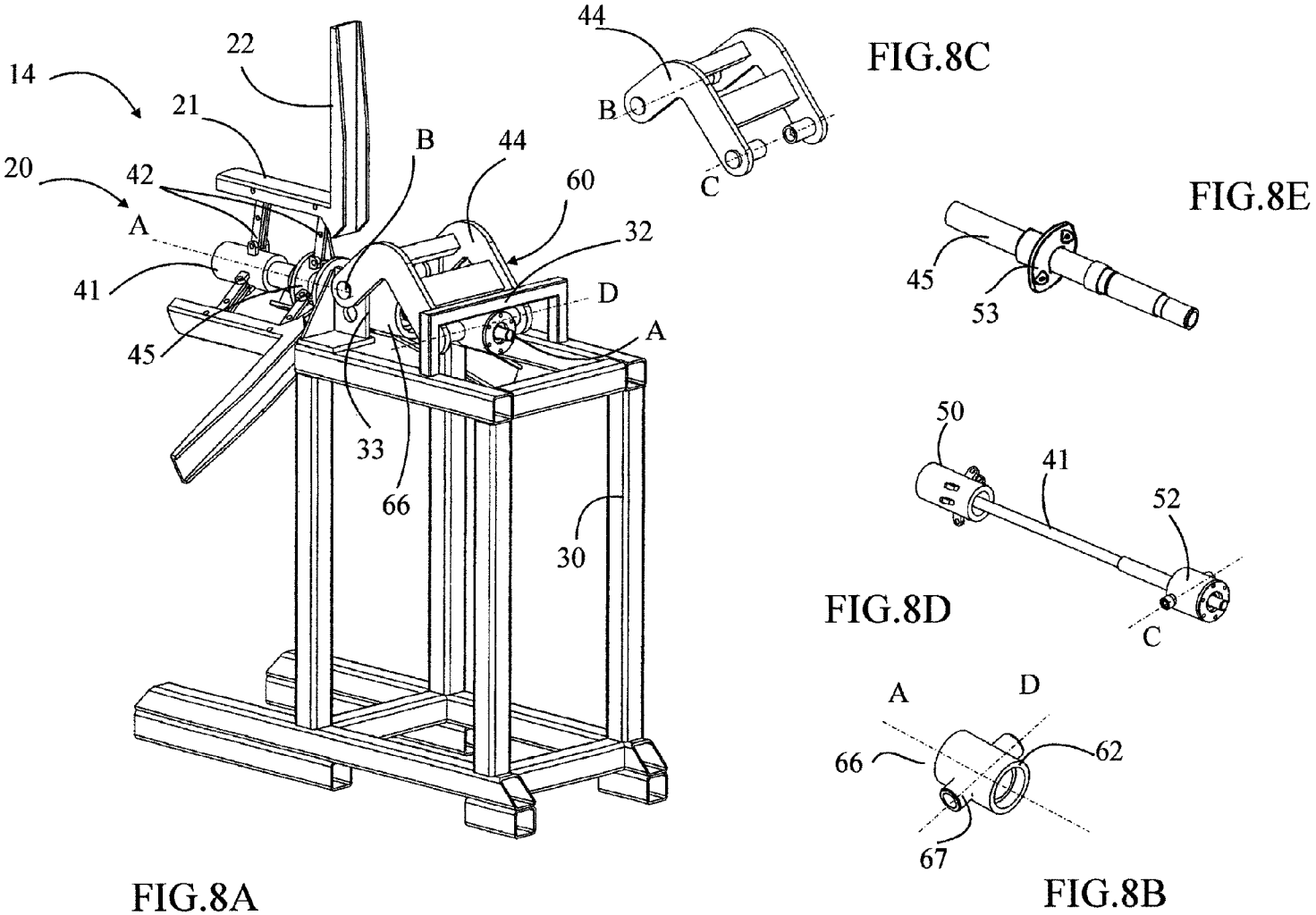
FIG. 8A is a perspective of a winder with a tilting mandrel according to the first embodiment of FIGS. 6A and 6B.
FIGS. 8B through 8E are detailed views of the parts of the winder of FIG. 8A.

A winder 14 with a tilting expanding mandrel according to the embodiment in FIGS. 6A and 6B is shown in FIG. 8A. Parts that are similar to those in the preceding examples bear the same reference numerals and are not described further. Winder 14 comprises an expanding mandrel 20 supported on a frame 30. Said mandrel 20 comprises three jaws 21 joined with links 42 to a pull rod 41 with axle A, shown in detail in FIG. 8D. Said pull rod 41 is joined to frame 30 by a connecting rod 44, shown in detail in FIG. 8C, which is C-shaped, with each extremity joined to frame 30 by a fixed articulating axle B and to pull rod 41 by a movable articulating axle C, respectively. Pull rod 41 is rotationally attached to its axle A by a bearing case and bearing stops (not shown), or other equivalent means, located in second socket 51. In a variation, pull rod 41 may be fixed and equipped at its front end with an axial stop or the like allowing mandrel 20 to rotate.

Winder 14 also comprises a rocker arm 66 shown in detail in FIG. 8B, equipped with a guide socket 62 connected to mandrel 20 by rotational axle A and a bearing rod 67 joined to frame 30 by a fixed pivot axle D, pivot axle D being perpendicular to and above axle A. A casing 45 shown in detail in FIG. 8E is rotationally mounted inside guide socket 62 with a bearing case and bearing stops (not shown) or other equivalent means. As in the preceding example, this casing is connected to jaws 21 with links 42 and it is traversed by sliding pull rod 41. It forms the fixed contact point for expansion device 40.

Said winder 14 also comprises mechanical stops positioned on frame 30 defining the loading and use positions for mandrel 20. In the example illustrated, stop 32 is formed of a traverse which the rear extremity of pull rod 41 abuts when the axle of mandrel 20 is horizontal. Stop 33 is formed of upright elements supporting fixed axles B and D which connecting rod 44 abuts when the axle of mandrel 20 is vertical. Said winder 15 also includes a recall device (not shown) that may be a counterweight (36) integral with rocker arm 66 and a lifting device 37 referenced in FIGS. 6 and 7.

POSSIBLE INDUSTRIAL APPLICATIONS

Winder 10-15 according to the invention is preferably made of machined metal parts, forged and/or molded, mechanically soldered or assembled using any appropriate method. It has applications in numerous industries: the manufacture of paper, cardboard, sheet metal, textiles, and so forth, and it may be adapted to all types of reel of any weight or diameter.

It is clear from this description that the invention achieves its stated objectives, specifically independent operation without any exterior source of energy, through a simple, economical, and maintenance-free concept.

The present invention is not limited to the embodiments described, but extends to any modification or variation obvious to a person skilled in the art while remaining with the scope of protection defined in the attached claims.

The invention claimed is:

1. An expanding-mandrel winder (10, 11, 12, 13, 14, 15) for a reel (1) equipped with at least one mandrel (20) attached to a frame (30), the mandrel (20) comprising at least three equidistant jaws (21) moving between a loading position in which the at least three jaws (21) are contracted and a use position in which the at least three jaws (21) are expanded and maintain the reel (1) on a generally horizontal axle, the winder comprises an engaging means (60) for automatically expanding the at least three jaws (21) under a weight of the reel (1) and clamping an interior diameter of the reel (1), placing the mandrel (20) in the use position;

a clamping force exerted by the at least three jaws (21) on the interior diameter of the reel (1) is proportional to the weight of the reel;

an expansion device (40) is connected to the at least three jaws (21) of the mandrel (20) and the engaging means comprises a guide device (60) for guiding the mandrel (20) between at least the loading position and the use position, the guide device (60) is connected to the expansion device (40) for automatically expanding the at least three jaws (21) simultaneously with the displacement of the mandrel (20) under the weight of the reel (1); and the expansion device (40) comprises a pull rod (41) connected to the at least three jaws (21) by a variable shape mechanism, and the pull rod (41) sliding within a rotational axle (A) of the mandrel (20) to displace the at least three jaws (21) between the loading position and an unloading position.

2. The winder according to claim 1, wherein a recall device (35, 36) connected to the engaging means (60) causes the jaws (21) to contract automatically in the absence of the reel (1) and the mandrel (20) to return to the loading position.

3. The winder according to claim 1, wherein a blocking mechanism (25) is joined to the engaging means (60) and locks the mandrel (20) in the use position.

4. The winder according to claim 1, wherein the pull rod (41) is connected to the frame (30) by at least one of an articulated connecting rod (44), a rack and pinion system (48, 49), a cylinder and a slider (46).

5. The winder according to claim 1, wherein the loading and the unloading positions of the mandrel (20) are parallel and the guide device (60) displaces the mandrel (20) along a generally rectilinear trajectory.

6. The winder according to claim 5, wherein the guide device (60) comprises a rocker (61) connected to the frame (30) by a fixed pivot axle (D) and to the mandrel (20) by the rotational axle (A), the fixed pivot axle (D) and the rotational axle (A) are parallel.

7. The winder according to claim 5, wherein the guide device (60) comprises a trolley (63) connected to the mandrel (20) by the rotational axle (A) and which slides within the frame (30) along an axle perpendicular to the rotational axle (A).

8. The winder according to claim 1, wherein the loading position and the unloading position of the mandrel (20) are perpendicular and the guide device (60) displaces the mandrel (20) along a generally circular trajectory.

9. The winder according to claim 8, wherein the guide device (60) comprises a rocker arm (66) connected to the frame (30) by a fixed pivot axle (D) and to the mandrel (20) by the rotational axle (A), the fixed pivot axle (D) and the rotational axle (A) are perpendicular and offset.

10. The winder according to claim 9, wherein the mandrel (20) comprises a receiving platform (22) which receives the reel (1) in the loading position.

11. The winder according to claim 9, wherein a recall device (36) comprises a counterweight connected to the rocker arm (66).

12. The winder according to claim 9, wherein a controlled lifting device (37) is located between the frame (30) and the rocker arm (66) for locking the mandrel (20) in the loading position and the use position and for controlling a return of the mandrel (20) into the loading position.

13. The winder according to claim 1, wherein the guide device (60) comprise a guide socket (62) which is coaxial with the rotational axle (A) of the mandrel (20), the pull rod (41) slides within the guide socket (62) by means of a casing (45) connected to the jaws (21) of the mandrel (20) by the variable shape mechanism.

14. The winder according to claim 13, wherein the casing (45) and the pull rod (41) are coaxial and rotationally attached along the rotational axle (A) of the mandrel (20).

15. The winder according to claim 1, wherein stops (32, 33) define the loading position and an unloading position of the mandrel (20).

16. An expanding-mandrel winder for a reel, the mandrel winder comprises:

at least one mandrel (20), which is supported by a frame (30), has at least three equidistant jaws (21) that extend parallel to a rotational axis (A), the at least three jaws (21) are biased between a loading position to load the reel on the winder and an in use position in which the reel is generally horizontally secured;

a pull rod (41) extends axially along the rotational axis (A) and centrally between the at least three jaws (21), the pull rod (41) communicates with the at least three jaws (21);

a biasing means (60) is supported by the frame (30) and communicates with the pull rod (41), the biasing means (60) automatically exerts a biasing force on the pull rod (41), which biases the at least three jaws (21) between the loading position and the in use position, in the loading position the at least three jaws (21) are biased to contract and in the in use position the at least three jaws (21) are biased to expand and clamp an interior diameter of the reel (1);

the biasing force exerted automatically by the biasing means (60) is dependent on a weight of the reel (1); and an expansion device (40) is connected to the at least three jaws (21) of the mandrel (20) and the engaging means comprises a guiding device (60) for guiding the mandrel (20) between at least the loading position and the use position, the guiding device (60) is connected to the expansion device (40) for automatically expanding the jaws (21) simultaneously with the displacement of the mandrel (20) under the weight of the reel (1);

the expansion device (40) comprises the pull rod (41) connected to the at least three jaws (21) by a variable shape mechanism, and the pull rod (41) sliding within a rotational axle (A) of the mandrel (20) to displace the jaws (21) between the loading position and an unloading position.

* * * * *